United States Patent [19]

Hampejs

[11] 4,116,112

[45] Sep. 26, 1978

[54] FLUIDIC AMPLIFIER

[75] Inventor: Karel Hampejs, Neuhausen am Rheinfall, Switzerland

[73] Assignee: SIG Schweizerische Industrie-Gesellschaft, Neuhausen am Rheinfall, Switzerland

[21] Appl. No.: 701,014

[22] Filed: Jun. 30, 1976

[30] Foreign Application Priority Data

Jul. 4, 1975 [CH] Switzerland ..... 8752/75

[51] Int. Cl.[2] ..... F15B 9/10

[52] U.S. Cl. ..... 91/380; 92/113

[58] Field of Search ..... 91/380

[56] References Cited

U.S. PATENT DOCUMENTS

| | | | |
|---|---|---|---|
| 2,410,049 | 10/1946 | Davis | 91/380 |
| 3,457,836 | 7/1969 | Henderson | 91/380 |

FOREIGN PATENT DOCUMENTS

| | | | |
|---|---|---|---|
| 2,309,283 | 9/1973 | Fed. Rep. of Germany | 91/380 |

*Primary Examiner*—Paul E. Maslousky

*Attorney, Agent, or Firm*—Spencer & Kaye

[57] ABSTRACT

Fluidic amplifier, particularly a hydraulic linear amplifier for converting a low-energy rotary movement of a control member into a linear setting movement of the piston rod of an operating piston, wherein: the control member is connected with a threaded spindle whose free end extends into an axial bore in the piston rod of the operating piston and mates with a spindle nut provided in the axial bore; the pressure fluid for charging the operating piston to produce the setting movement of the piston rod is controllable by means of an axial deflection of the control piston of a control valve, which deflection is effected by the control member and the threading of the threaded spindle into the spindle nut, and this setting movement causes the control piston to be repositioned to its starting position. A protective device is provided within the amplifier for the automatic separation of the mechanical connection between the operating piston and the control piston during a malfunction.

5 Claims, 7 Drawing Figures

FLUIDIC AMPLIFIER

BACKGROUND OF THE INVENTION

The present application relates to a fluidic amplifier, particularly a hydraulic linear amplifier for converting a low-energy rotary movement from a control member into a linear setting movement of a piston rod of an operating piston. More particularly, the present invention relates to such a hydraulic linear amplifier, wherein the control member is connected to a threaded spindle whose free end extends into an axial bore of the piston rod and engages in a spindle nut provided in the axial bore, and wherein the pressure fluid charging the operating piston can be controlled via the axial deflection of the control piston of a control valve, which deflection is effected by the control member and the threaded spindle, in order to produce the setting movement of the piston rod, and this setting movement itself can be used to effect a repositioning of the control piston.

In such linear amplifiers, the force is transferred by the piston rod directly to the machine part to be moved without the use of complicated translation mechanisms, which often operate with play in rotary drives. The amplifiers provide precise control of movement and high system rigidity and are suitable for advancing movements as well as for accurate positioning. The drawback in the known amplifiers is their susceptibility to malfunctions. Thus, the amplifier may suffer damage if, for example, a great external force acts on the piston rod when the cylinder is without pressure or if the piston rod cannot overcome the external forces acting on it.

SUMMARY OF THE INVENTION

In order to overcome the above-mentioned drawback, the amplifier is provided, according to the invention, with a protective device for the automatic separation of the mechanical connection between the operating piston and the control piston during the occurrence of a malfunction.

According to one embodiment of the invention, this is accomplised by mounting the spindle nut within the axial bore of the operating piston rod by means of an expanding sleeve which is frictionally seated in the axial bore. In this manner whenever a predetermined limit force is exerted, for example, when movement of the operating piston is blocked and the threaded spindle is rotating, the spindle nut will be displaced relative to the operating piston, thus separating the mechanical connection between the operating piston and the control piston of the control valve.

According to another embodiment of the invention the threaded spindle is essentially formed in two parts with one part constituting the threaded spindle itself and the remainder constituting an input shaft which is connected to the control member. The end of the threaded spindle is provided with an axial bore with only the end portion being threaded, and the adjacent end of the input shaft is provided with a threaded pin which extends into the axial bore of the threaded spindle and is normally engaged by the threaded portion of the axial bore. Consequently upon the occurrence of a malfunction, for example, the blocking of the operating piston, continued rotation of the input shaft will cause same to be unscrewed from the threaded spindle after a predetermined amount of relative rotation, thus separating the mechanical connection between the control piston of the control valve and the operating piston.

In both embodiments of the invention, according to a further feature of the invention, an arrangement is provided for permitting re-establishment of the mechanical connection between the control and operating pistons without requiring that the hydraulic amplifier be disassembled.

DETAILED DESCRIPTION OF THE PREFERRED EMBODIMENTS

Figure 1:
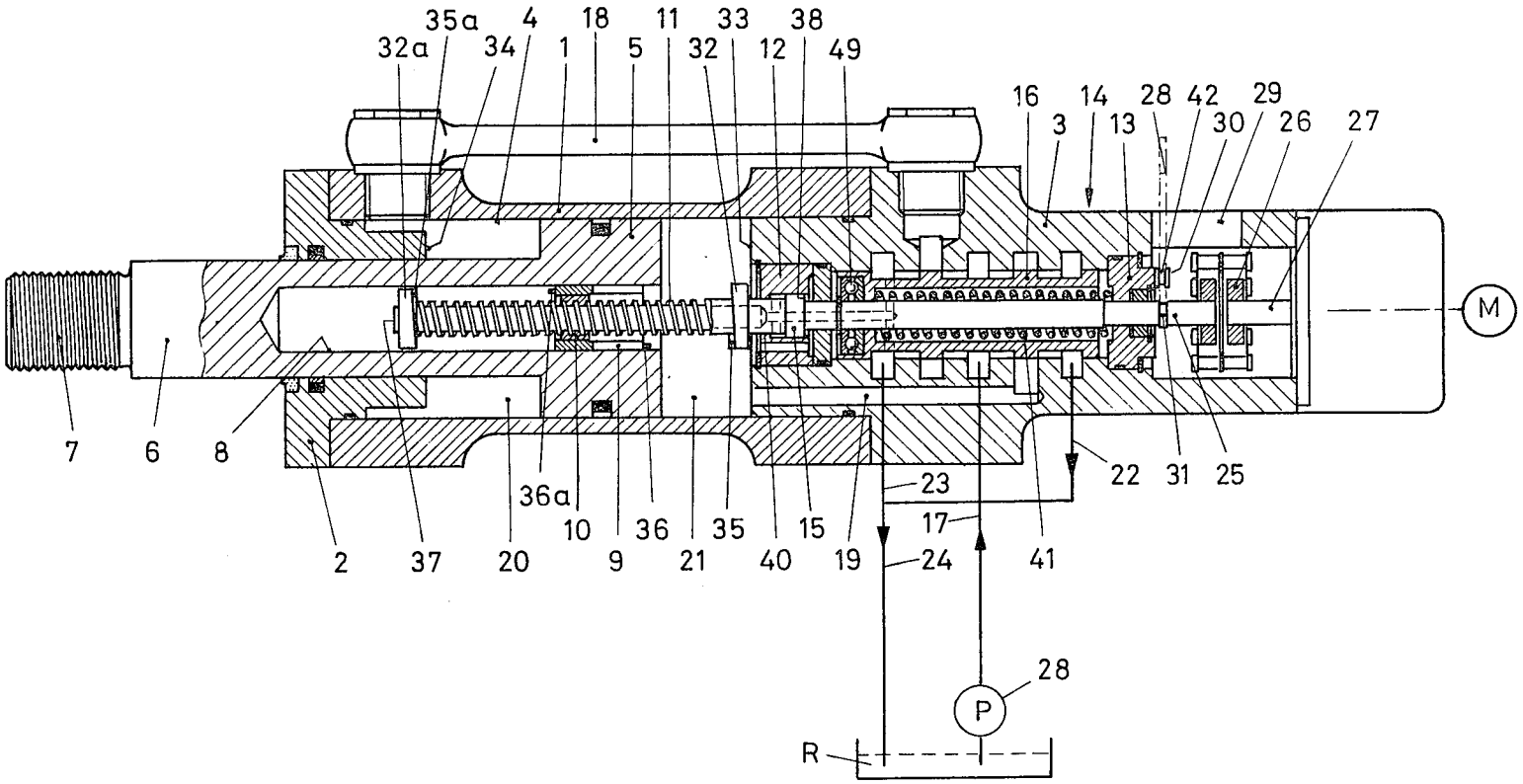
FIG. 1 is a longitudinal sectional view of a first embodiment of a hydraulic linear amplifier according to the invention.

The hydraulic linear amplifier according to FIG. 1 includes a setting cylinder 1 which is closed at one end by a cylinder cover 2 and is connected at its other end with the valve housing 3. An operating piston 5 is provided in the bore 4 of cylinder 1 where it is secured against rotation in a manner not shown in detail. The operating piston 5 is disposed at the inner end of a piston rod 6, which passes through cover 2, and is provided with a thread 7 at its free end. The inner end of the piston 5 and piston rod 6 is provided with an axial bore 8 in which an expanding sleeve 9, which will be discussed further below, is mounted with a friction seat so that sleeve 9 is axially displaceable by a limit force acting on piston rod 6. The expanding sleeve 9 may advisably be axially slit and be seated in bore 8 with a radial bias. A nut 10 is firmly seated in the interior of expanding sleeve 9 with the thread of nut 10 mating with that of an axially extending threaded spindle 11. The spindle 11 extends, with play, into the bore 8 and is disposed in axially spaced guide bushings 12 and 13 provided in valve housing 3. A compensating piston 15 disposed in guide bushing 12 serves to provide compensation for the axial thrust of threaded spindle 11 in a manner to be described below.

A control piston 16, which is provided with annular grooves and guide edges, is axially displaceably disposed in the valve housing 3 of a known control valve 14. Connected to the valve housing 3 is a central inlet line 17 which is connected with the output of a oil pressure source or pump P whose input is connected with an oil reservoir R. An oil line 18 and a channel 19 connect the interior of control valve 14 with the front and the rear pressure chambers 20 and 21, respectively, of the setting cylinder 1. As a result of the arrangement of annular grooves and guide edges on the surface of the control piston 16, the control oil entering control valve 14 via inlet line 17 can pass, depending on the position of control piston 16, through line 18 or channel 19 into the front or rear pressure chamber 20 or 21, respectively, of the setting cylinder 1. The oil, again depending on the position of control piston 16, can flow from pressure chambers 20, 21 through the same channel 19 or the same line 18, respectively, back to control valve 14 from which it is returned via the one or the other of outlet lines 22 and 23 and via a common return line 24 to the reservoir R of the pressure oil source P.

On the drive side, the spindle 11 has an extension 25 which is designed as an input shaft and is connected via an axially elastic, torsion resisting coupling 26 and a drive shaft 27 with a control member, for example an electrical stepping motor M. The coupling 26 which will be described in greater detail below provides compensation for axial deflections of the threaded spindle 11 or of the drive shaft 27.

In operation, if the threaded spindle 11 is rotated in a clockwise direction by motor M via coupling 26, the spindle 11 screws itself into nut 10 and carries control piston 16 along toward the left. Movement of control piston 16 to the left results in a fluid connection between inlet line 17 and line 18, and a fluid connection between channel 19 and outlet line 22. Thus pressure oil can flow now from inlet line 17 through line 18 into the front pressure chamber 20 and move operating piston 5 toward the right while at the same time oil from the rear pressure chamber 21 flows via channel 19 into outlet line 22. The movement toward the right of operating piston 5 causes control piston 16 to be moved back toward its rest position which is reached when threaded spindle 11 is no longer being rotated. An axial antifriction bearing 49 disposed within control valve 14 assures the precise translation of the axial movement of the rotating spindle 11 to the nonrotating control piston 16.

In a similar manner, if the threaded spindle is rotated in a counterclockwise direction, the axial movement of spindle 11 carries control piston 16 along to the right so that pressure oil can now flow from inlet line 17 through channel 19 into the rear pressure chamber 21 in order to move the operating piston 5 toward the left. The movement of piston 5 toward the left expels the oil from the front pressure chamber 20 via line 18 into outlet line 23 and the control piston 16 is pressed back into its starting position.

With the above-described hydraulic linear amplifier it is possible to convert a low-energy rotary movement delivered by motor M into a high-energy axial movement delivered by the free end of piston rod 6. In order to protect the amplifier from overloads, for example, if a strong external force acts on the piston rod 6 when the cylinder 1 is without pressure or if the piston rod 6 cannot overcome the forces acting on it, according to the invention a protection device is provided. This protection device in this embodiment of the invention is in the form of an expanding sleeve, i.e., the expanding sleeve 9. This sleeve 9 can be shifted in both directions in the axial bore 8 by a limit force acting on piston rod 6 of such a magnitude that it will not as yet damage threaded spindle 11, and thus automatically separate the effective connection between the operating piston 5 and the control piston 16 upon the occurrence of a malfunction.

In the event the expanding sleeve 9 and nut 10 have been shifted out of their proper position in bore 8, provision is made for applying an external influence to bring the sleeve 9 and the nut 10 back to their correct position without having to disassemble the amplifier. In order to exert this external influence or force, a forked lever 28 (which is shown in dotted line in FIG. 1) is inserted into an opening 29 at the end of valve housing 3 which faces the coupling 26 and is pushed via pin 30 into the annular groove 31 provided on the spindle extension 25. Pin 30 which is also provided with an annular groove 42 is fastened to the frontal face of guide bushing 13. However, before lever 28 is actuated, which would result in a deflection of control piston 16 and thus movement of operating piston 5, spindle 11 is rapidly rotated, for example, in a clockwise direction, causing nut 10, which can freely rotate on threaded spindle 11, to move toward the end abutment flange 32. If lever 28 is now actuated so as to cause piston rod 6 to move inwardly, bore 8 in the piston rod 6 will again be pushed over expanding sleeve 9 of nut 10 until operating piston 5 comes to rest against the inner stroke limitation 33 of setting cylinder 1.

In an analogous manner, nut 10 can also be moved toward the other end abutment flange **32*a* of spindle 11. In this case, however, lever 28 must be operated so that operating piston 5 comes to abut against the outer stroke limitation 34**.

Figure 7:
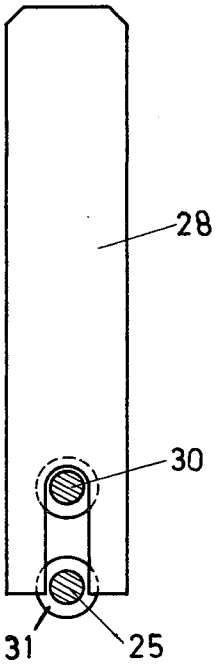
FIG. 7 is a front view of the forked lever according to FIG. 6.
Figure 6:
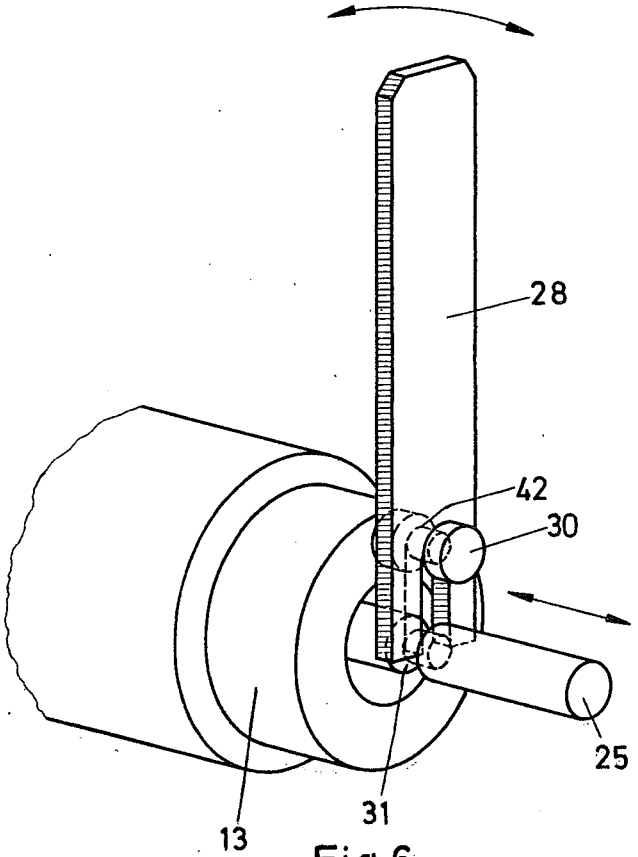
FIG. 6 is a perspective view of a forked lever being used for adjusting the hydraulic linear amplifier according to the the embodiment of the invention shown in FIG. 1.

In FIGS. 6 and 7 the forked lever 28 is shown inserted into the annular groove 31 provided on the spindle extension 25.

In order to prevent the thread of nut 10 from becoming jammed in the thread of spindle 11 when one of the end positions 33 or 34 of piston 5 is reached, so that motor M is no longer able to disengage nut 10, both abutment flanges 32 and **32*a* of spindle 11 are provided with protrusions 35 and 35*a*, respectively, which come into engagement with an associated protrusion 36 or 36*a*, respectively, at each end of expanding sleeve 9 shortly before the associated one of the end positions 33 or 34 has been reached. Protrusions 35, 36, 35*a*, 36*a* may advisably be pins or cams which prevent further rotation of threaded spindle 11** by motor M into the end positions.

These protrusions 35, 36, **35*a*, 36*a*, are also required if expanding sleeve 9 has been shifted out of its correct position and has to be returned thereinto. If, for example, the expanding sleeve 9 has been shifted toward the left from its correct position due to excess stress on the operating piston 5, and operating piston 5 is now moved toward the left by counter-clockwise rotation of spindle 11, piston 5 will be unable to reach the limitation of its stroke 34 since the expanding sleeve 9 abuts on abutment 32*a* of spindle 11. Protrusions 35*a* and 36*a* here prevent self-retention which could be impossible to disengage from the outside. However, by deflecting control piston 16 by means of lever 28, the operating piston 5 may be pressed against its stroke limitation 34 by the pressure oil in chamber 21 and thus cause expanding sleeve 9** to automatically be returned to its correct position.

In order to relieve the threaded spindle 11 of the axial forces additionally acting on the core of the thread as a result of the fluctuating magnitude of the hydraulic pressure acting on its frontal face 37, an axial thrust compensation is provided. In this case the annular surface 38 of compensating piston 15 on which the cylinder pressure acts corresponds to the cross section of the core of threaded spindle 11 at point 40. Thus the remaining axial force with which the sides of the threads of spindle 11 and nut 10 are pressed against each other depends only on the force of spring 41. With such unilateral force in the form of a spring it is accomplished that only one side of the thread of the spindle in nut 10 is stressed which permits precise movement of the spindle 11 without play.

Figure 2:
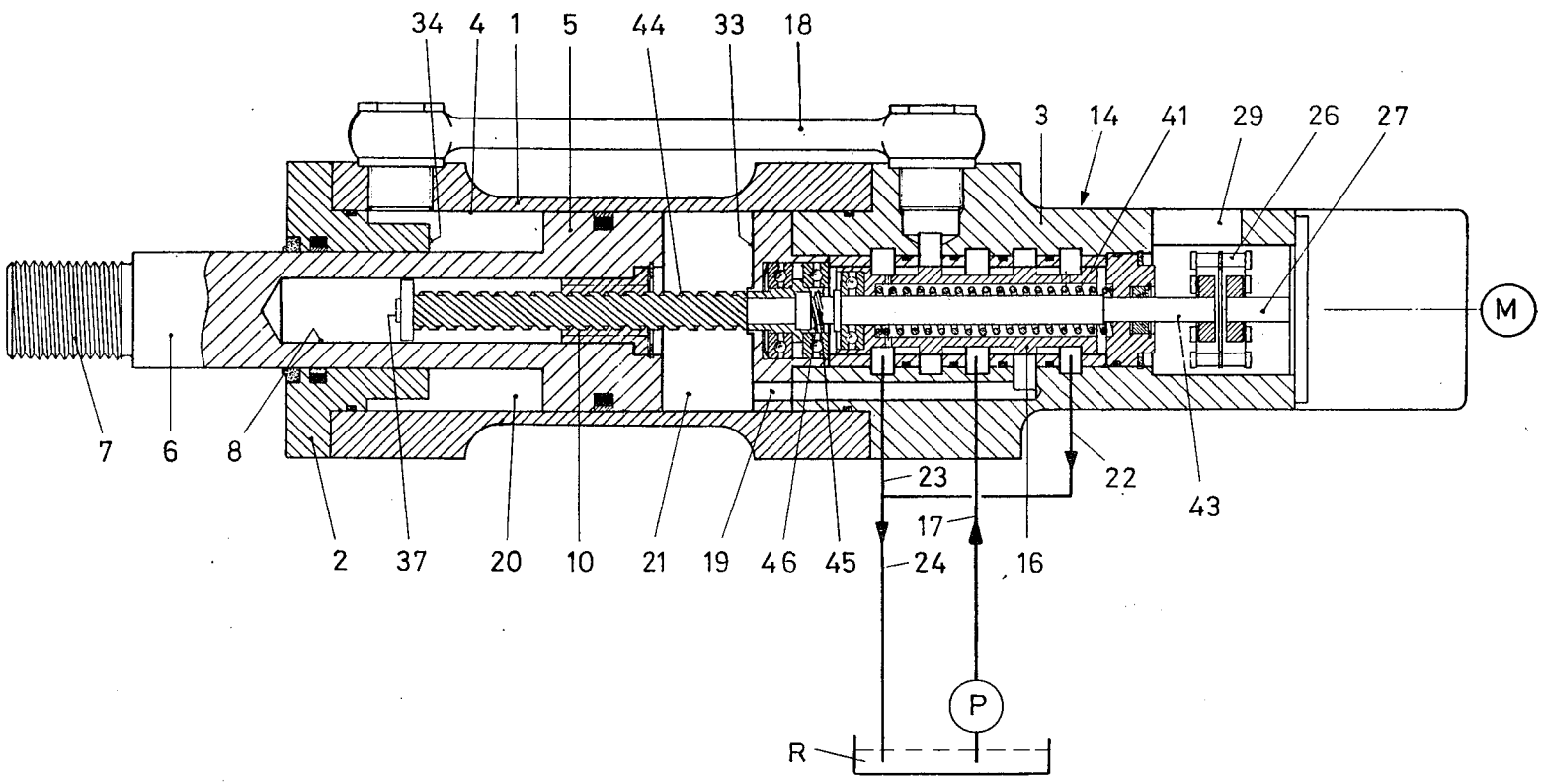
FIG. 2 is a longitudinal sectional view of a second embodiment of a hydraulic linear amplifier according to the invention.
Figure 4:
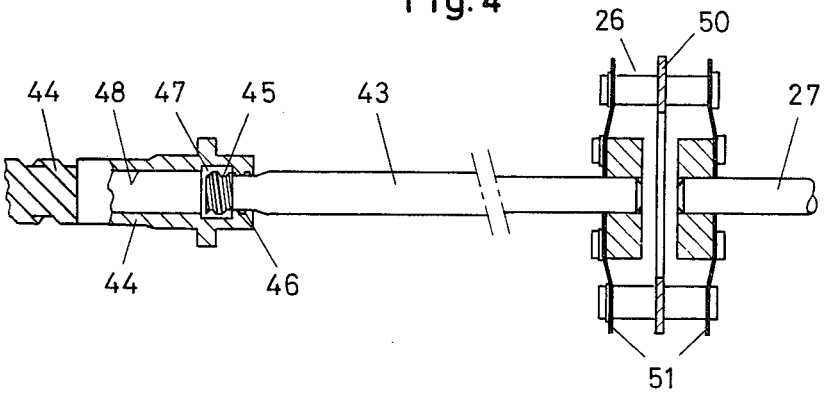
FIGS. 3 to 5 show the screw connection between the threaded spindle and the input shaft of the embodiment of FIG. 2, as well as the axially elastic coupling for the input shaft, in three different positions.
Figure 3:
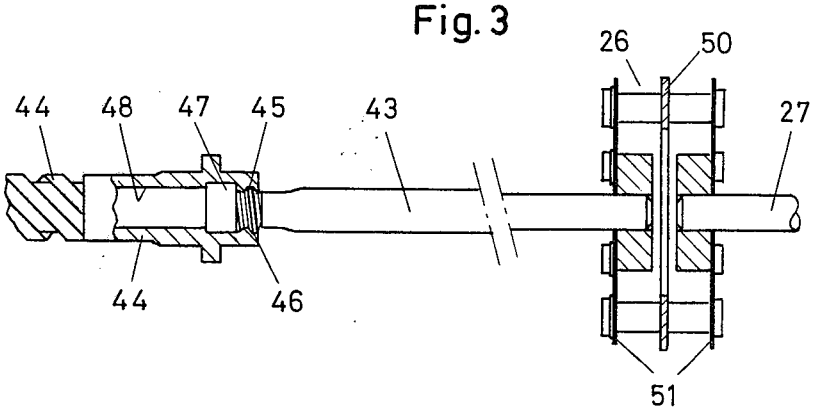
Figure 5:
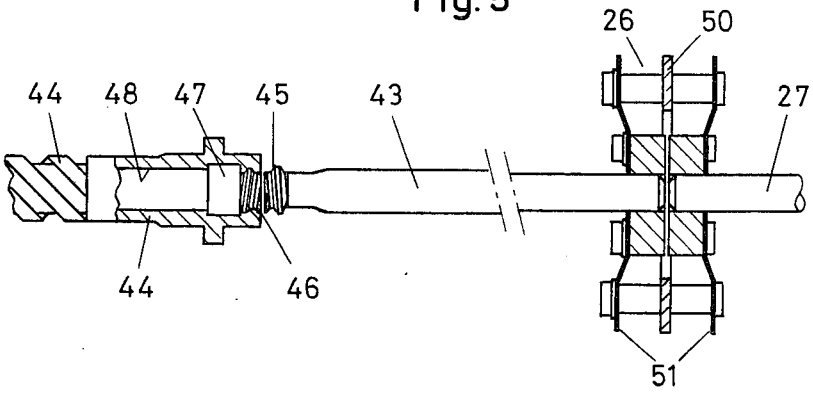

In the second embodiment of a hydraulic linear amplifier as shown in FIG. 2, the threaded spindle 44 engages with a self-arresting trapezoidal thread into the nut 10 which is firmly seated in operating piston 5 with adjustable play. Contrary to the embodiment of FIG. 1, in this embodiment the threaded spindle 44 and input shaft 43 are not provided as a unitary piece but rather are screwed into one another. For this purpose, as best shown in FIGS. 3–5, the end of the threaded spindle 44 is provided with a threaded portion 46 at the end of an axial bore 48, which threaded portion 46 normally engages a threaded pin 45 on the end of input shaft 43. The remainder of axial bore 48 is not provided with any threads and contains a widened portion 47 immediately following the threaded portion 46.

In operation, if the threaded pin 45 at the end of input shaft 43 is rotated in a clockwise direction by motor M via coupling 26, the pin 45 screws itself into the threaded portion 46, which is part of spindle 44, and carries control piston 16 along towards the left. Movement of control piston 16 to the left results, by means of fluid flow in a movement of operating piston 5 towards the right. The axial movement to the right of piston 5 causes by means of thread 10, a clockwise rotation of spindle 44 (as seen from the motorside), since spindle 44 is axially fixed. Thus input shaft 43 and spindle 44 rotate synchronously and the differential angle displacement between pin 45 and threaded portion 46 corresponds to the fluid flow necessary to maintain the set speed. When the motor M stops, the input shaft 43 also stops rotating. As piston 5 continues to move axially toward the right it causes, by means of thread 10, a clockwise rotation of spindle 44 and the threaded portion 46, resulting in the threaded pin 45 being screwed out of the threaded portion 46 in a direction toward the right. Since the threaded pin 45 in part of the input shaft 43, the latter also moves toward the right, causing the control piston 16 (which moves axially with the input shaft 43) to return to its initial position, thus stopping the fluid flow which caused the initial movement of piston 5 toward the right.

As a result of the manner of connecting the input shaft 43 and the threaded spindle 44, and the relationship between the parts 45–48, the connection between the operating piston 5 and the control piston 16 is likewise automatically separated upon the occurrence of a malfunction. For example, if operating piston 5 is blocked, the input shaft 43 driven by motor M can nevertheless continue to rotate since threaded pin 45 will be screwed out of engagement with threaded portion 46 after a certain small amount of relative rotation, and input shaft 43 can then be freely rotated. In particular, after such disengagement, with clockwise rotation, threaded pin 45 will enter the widened portion 47 of spindle bore 48 which has no thread (FIG. 4), and with counterclockwise rotation, pin 45 will be screwed completely out of the bore 48 of threaded spindle 44 (FIG. 5). This causes input shaft 43 to be axially shifted out of its normal operating position (FIG. 3).

In addition to providing compensation for normal axial deflections, the torsion resistant, axially elastic coupling 26 can elastically compensate the axial deflections resulting from axial movement of shaft 43 relative to spindle 44 and additionally simultaneously exerts a force on input shaft 43, which force is directed opposite the respective deflection of input shaft 43, in order to press threaded pin 45 against the threaded portion 46, and thus permit re-engagement of the threads of pin 45 with the threaded portion 46 in a simple manner. In particular, as soon as the direction of rotation of input shaft 43 which caused disengagement is reversed by a control order, the threaded pin 45 is again screwed into threaded portion 46 of bore 48 and the connection between operating piston 5 and control piston 16 is reestablished.

To provide these functions, as best shown in FIGS. 3–5, the coupling 26 is designed to be cylindrical and is provided with a perforated disc 50 which is disposed perpendicularly to the axis of the shafts 27 and 43. On each side of the perforated disc 50 there is securely fastened, in a spaced symmetrical manner, an elastic side wall or disc 51 to which the input shaft 43 or the drive shaft 27, respectively, are fastened. During axial deflections of input shaft 43, side walls 51 can be curved convexly (FIG. 4) or concavely (FIG. 5) to provide axial compensation and simultaneously to exert an axial force on shaft 43 tending to restore shaft 43 to its normal axial postion.

It will be understood that the above description of the present invention is susceptible to various modifications, changes and adaptations, and the same are intended to be comprehended within the meaning and range of equivalents of the appended claims.

What is claimed is:

1. In a hydraulic linear amplifier for converting a low-energy rotary movement of a control member into a linear setting movement of a pistion rod of an operating piston mounted in a cylinder for linear movement, wherein said control member is connectable with one end of a rotatably mounted but axially fixed threaded spindle via an input shaft which is coaxial with said spindle and which is mounted so that it is rotatable about and movable along its longitudinal axis; wherein an opposite free end of said threaded spindle extends into an axial bore in said piston rod of said operating piston and through a spindle nut mounted in said axial bore with threads of said threaded spindle matingly engaging said spindle nut; wherein hydraulic pressure for charging said operating piston to produce a setting movement of said piston rod is controllable by means of an axial deflection of a control piston of a control valve which is connected to said cylinder via pressure lines; wherein first means are provided for connecting said control piston to said input shaft for axial movement therewith; and wherein second means are provided for connecting said input shaft to said threaded spindle so that rotation of said input shaft by said control member results in said axial deflection of said input shaft, and hence of said control piston, to cause said setting movement of said piston rod and said setting movement causes said control piston to be axially repositioned to its starting position, said second means including a threaded axial bore formed in said one end of said threaded spindle and engaging a threaded pin on an adjacent end of said input shaft; the improvement further comprising: means, upon the occurrence of interference with the movement of said operating piston, for automatically and nondestructively disengaging said threaded pin and said threaded axial bore after a predetermined amount of relative rotation so that said input shaft can thereafter be freely rotated; and means for aiding in the reestablishment of the mechanical screw conncection between said threaded pin of said input shaft and said threaded axial bore of said threaded spindle upon reversal of the rotary movement of said input shaft.

2. An amplifier as defined in claim 1 wherein: said axial bore of said threaded spindle is provided with threads only for a portion thereof adjacent said one end; said means for disengaging includes a widened unthreaded portion of said axial bore of said spindle with said widened portion immediately following said threaded portion so that said threaded pin, depending on the direction of rotation of said input shaft, can be screwed out of said threaded portion of said axial bore and either inserted into said widened portion of said bore or removed completely from said spindle bore; and said means for aiding in the reestablishment of said screw connection includes means for exerting an axial force on said input shaft, when said threaded portion of said axial bore and said threaded pin are disengaged from one another, which tends to press said threaded pin against said threaded portion of said bore.

3. An amplifier as defined in claim 2 wherein said means for exerting an axial force on said input shaft when said threaded portion of said axial bore and said threaded pin are disengaged comprises a torsion resistant, axially elastic coupling connecting said input shaft with said control member so that said coupling can compensate axial deflections of said input shaft.

4. An amplifier as defined in claim 3 wherein said coupling exerts a force on the deflected input shaft which is directed opposite the deflection.

5. An amplifier as defined in claim 3 wherein the cylindrically designed coupling has two axially elastic side walls disposed perpendicular to the axis of said input shaft, one of said side walls being connected to a drive shaft of said control member and the other of said side walls being connected to said input shaft, with said walls being symmetrically disposed on either side of a perforated disc to which they are fastened in a manner so that they are capable of being convexly or concavely curved during axial deflections of said input shaft.

* * * * *